US005582111A

United States Patent [19]

De Ro et al.

[11] Patent Number: 5,582,111

[45] Date of Patent: Dec. 10, 1996

[54] RAILWAY AXLE WITH ORIENTABLE WHEELS AND VARIABLE WIDTH

[75] Inventors: Michel De Ro, Nivelles; Pascal DeBaille, Montigny-le-Til; Jean-Pierre Vin, Brussels; Michel Vandamme, La Louviere, all of Belgium

[73] Assignee: Bombardiere Eurorail S.A., Belgium

[21] Appl. No.: 64,059

[22] PCT Filed: Oct. 25, 1991

[86] PCT No.: PCT/BE91/00077

§ 371 Date: Aug. 18, 1993

§ 102(e) Date: Aug. 18, 1993

[87] PCT Pub. No.: WO92/08635

PCT Pub. Date: May 29, 1992

[30] Foreign Application Priority Data

Nov. 12, 1990 [BE] Belgium ..... 9001063

[51] Int. Cl.[6] ..... B61F 5/00

[52] U.S. Cl. ..... 105/167; 105/178

[58] Field of Search ..... 105/165, 166, 105/167, 168, 169, 178

[56] References Cited

U.S. PATENT DOCUMENTS

| | | | |
|---|---|---|---|
| 86,685 | 2/1869 | Perry | 105/168 |
| 466,009 | 12/1891 | Oakman | 105/166 |
| 763,807 | 6/1904 | Stuebner | 105/165 |
| 2,042,623 | 6/1936 | Oster | 105/165 |
| 2,046,448 | 7/1936 | Buigne | 105/165 |
| 2,756,688 | 7/1956 | Furrer | 105/168 |
| 2,956,515 | 10/1960 | Lich | 105/168 |
| 3,254,610 | 6/1966 | Roley | 105/169 |
| 3,557,707 | 1/1971 | Joy | 105/169 |
| 3,808,693 | 5/1974 | Plasser et al. | 105/178 |
| 5,020,446 | 6/1991 | Potthoff | 105/169 |

FOREIGN PATENT DOCUMENTS

| | | | |
|---|---|---|---|
| 0510916 | 4/1952 | Belgium | 105/178 |
| 0533806 | 12/1954 | Belgium | 105/178 |
| 0144821 | 6/1985 | European Pat. Off. . | |
| 0348378 | 12/1989 | European Pat. Off. | 105/168 |
| 4039540 | 12/1991 | Germany | 105/165 |
| 0192282 | 10/1937 | Switzerland | 105/169 |
| 0199630 | 12/1938 | Switzerland | 105/169 |
| 1477607 | 5/1989 | U.S.S.R. | 105/165 |

*Primary Examiner*—Mark T. Le

*Attorney, Agent, or Firm*—Abelman, Frayne & Schwab

[57] ABSTRACT

A railway axle assembly with orientable wheels (8) is compensated in width when passing on a railway track curve. The assembly comprises side beams (5,5') articulated to the opposing ends of a telescoping axle (4). The side beams (5,5') are coupled to each other by at least one connecting rod device comprised of at least one broken rod (13) hinged at a breaking point to a lever-relay (15,25) carried by the axle (4) so as to entrain the breaking point in an angular displacement of an arc of a circle in a direction opposite to that of the beams (5,5') in order to compensate for the width loss of the axle when taking curves.

7 Claims, 14 Drawing Sheets

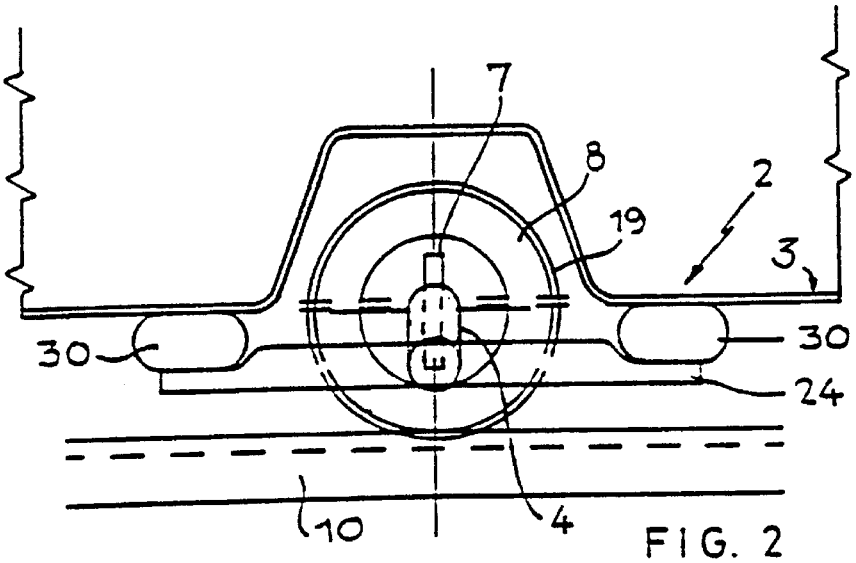
FIG. 2
FIG. 4
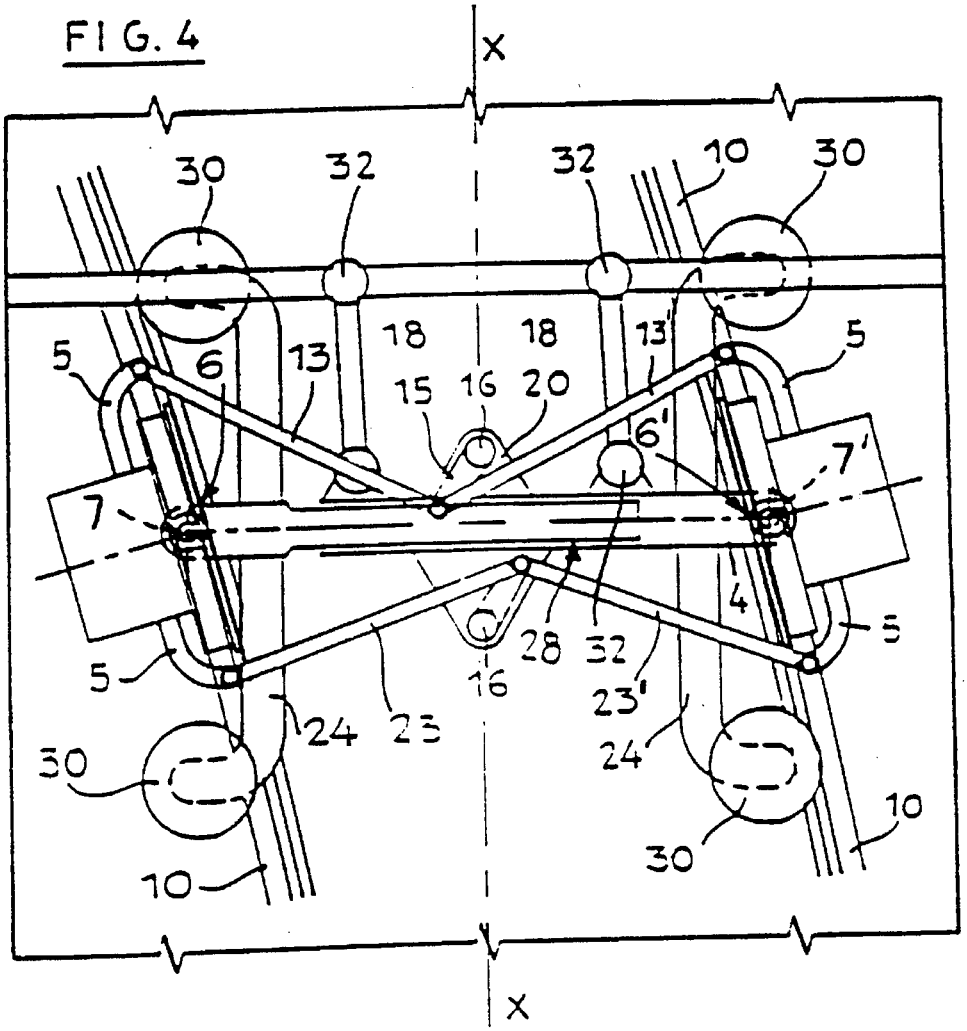

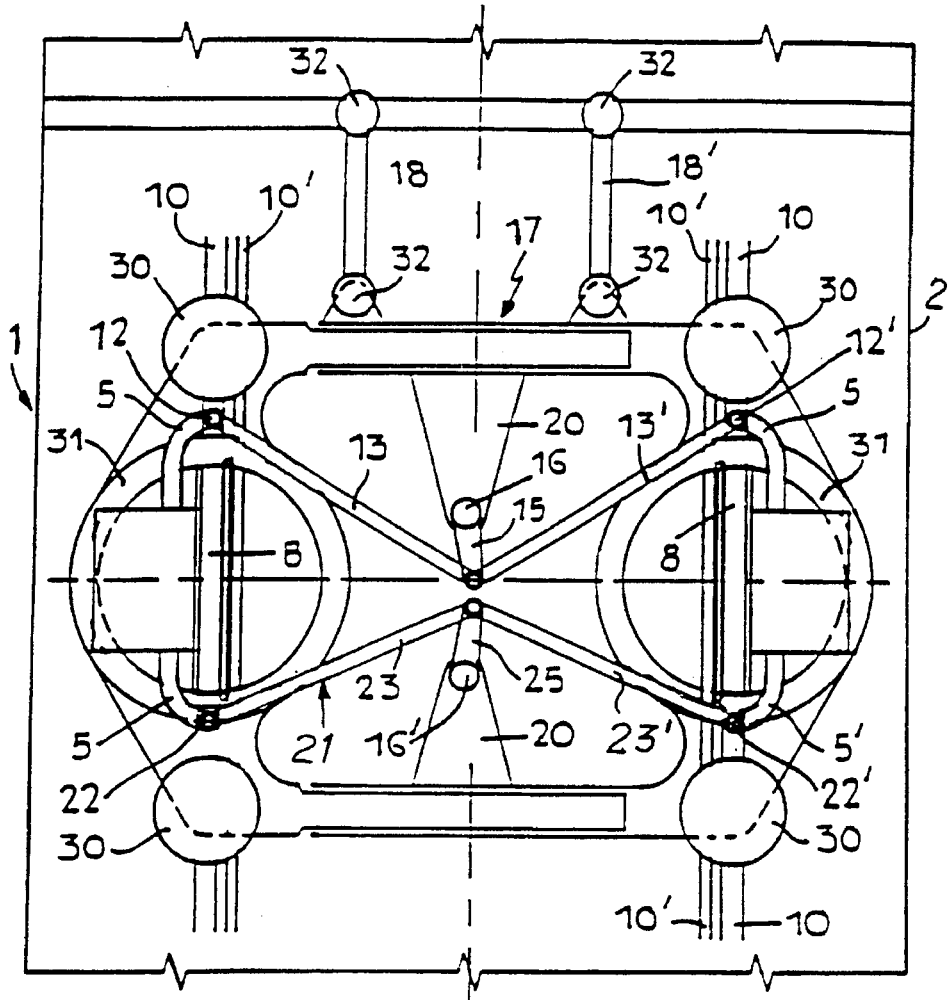
FIG. 5
FIG. 7
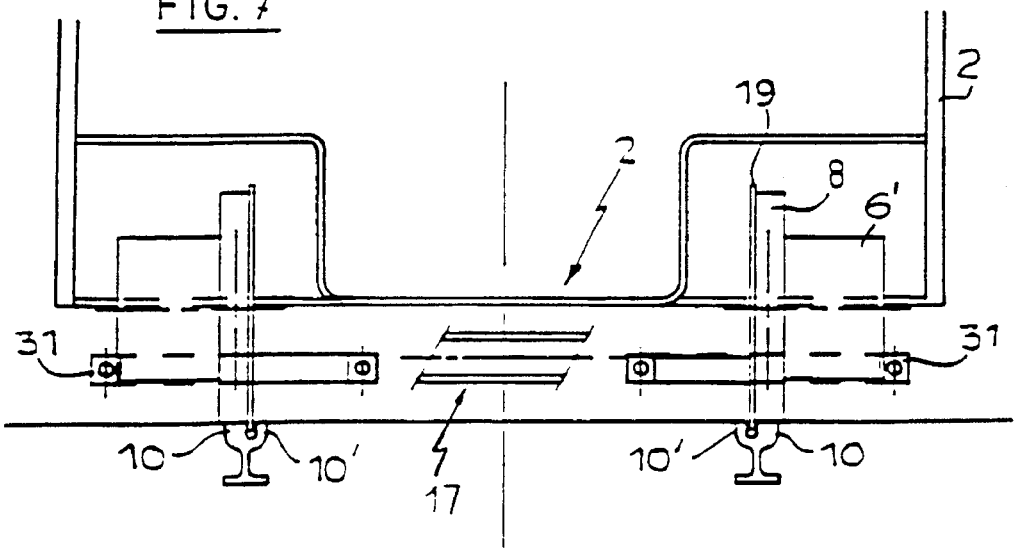

RAILWAY AXLE WITH ORIENTABLE WHEELS AND VARIABLE WIDTH

BACKGROUND OF THE INVENTION

1. Field of the Invention

The present invention relates to a railway axle equipped with orientable or pivoted wheels and which is of variable width. The axle comprises two side bars articulated to an axle cross member carrying a vehicle body, so that it is able to pivot directionally and also is able to be inclined in a vertical plane, so as to allow each wheel carried by the side bars to follow the curvatures of the railway track and to negotiate unevennesses in the track.

The invention finds its main application in vehicles running on rails in a local network, especially when the rails include tight bends or curves. The invention makes it possible to lower at least a portion of the floor surface of the body of the vehicle over the entire length of the body.

2. Description of the Prior Art

Various types of articulated railway bogies are known, in which the wheels which are mounted either on an axle body or on articulated side bars that are capable of swinging independently about vertical pivots so as to be oriented either separately and freely, or simultaneously and in a coordinated manner, tangentially to the curvatures of the track.

Document EP-A-0,144,821 discloses a bogie in which axles with orientable wheels are directionally integral with the track, these axles assuming an oblique position with respect to the track without being oriented towards the same instantaneous center of rotation. This assembly tends to increase the clearance between the wheel flanges and the rails and to decrease the clearance between the wheel flanges and the safety rails.

Such bogies can only be used on tracks with a large radius of curvature or on tracks without safety rails, such as the tracks used for railways and underground lines, and, possibly those used for trams running on a separate roadbed.

Also, documents BE-A-8700527 and EP-B-0,348,378 disclose bogies with articulated side bars equipped with a device making the spacing between the wheels and the width of the track a constantly good fit. Each side bar consists of two sections articulated about vertical pivots, each section carrying at least one wheel and being directionally controlled by a system of linkages assembled with ball joints.

On curved track, the sections of each side bar pivot with respect to the cross member and with respect to one another, while the cross member remains perpendicular to the axis of the body of the vehicle, so as to orient each wheel flange tangentially to the portion of curved track or parallel to the portion of straight track on which it bears.

The side bars of the bogie which is described in the first document pivot horizontally about two separate pivots which are fixed with respect to the cross member and the result is that the distances between the planes of the left-hand and right-hand wheels decrease progressively when beginning to run in a straight line in order to reach, in tight curves or bends, values which are incompatible with those of the track.

The bogie of the second document makes it possible to keep the clearances and the tolerances between the wheel flanges and the rails on the one hand and the safety rails on the other hand constant by virtue of a pivot off-centering device. Such a bogie must, however, be somewhat overengineered in order to provide sufficient transverse stiffness between wheels mounted in a canti-lever manner. This increase its weight and cost.

SUMMARY OF THE INVENTION

The present invention has as an object to overcome these drawbacks. Its objects are to provide an axle assembly or bogie axle assembly with orientable wheels and variable width axle which assembly is of small bulk and which is particularly suited to railway vehicles with a lowered floor intended to run on rails fitted with safety rails with constant spacing, and particularly suited to entering very tight bends or curves while compensating for a loss of width of the axle when it passes round the bend.

These objectives are obtained with the aid of an axle assembly according to the invention with orientable wheels and variable width of the type described in the first paragraph of this application, characterized in that the side bars are coupled to one another by at least one connecting rod device consisting of a broken or divided connecting rod, the ends of which rods are articulated or joined at the break point, to a relay lever affixed to the axle so as to drive the break point in an angular displacement on a circular arc, in a direction that is opposite to that of the side bars, so as to decrease the break angle of the broken connecting rod, and to compensate for the decrease in width of the axle in bends.

The connecting rod device according to the invention has the advantage of allowing rail vehicles with a lowered floor to run on rails of an already-existing infrastructure even if these rails are equipped with safety rails. To this end, it corrects the length of at least one connecting rod which couples the side bars in order to compensate for the loss in spacing of the side bars which form the opposite sides of an articulated four-bar structure, when the railway vehicle enters a bend.

For example, when the side bars swings to the left in a left-hand curve, the relay lever for a broken connecting rod turns about its pivot in a direction opposite to that of the side bars carrying wheels. This circular or arc-shaped displacement of the end of the relay lever articulated to the connecting rod in line with the break point of the connecting rod decreases the break angle and leads to an increase in the distance separating the ends of the broken connecting rod.

The extension of the connecting rod for coupling together the side bars makes it possible to keep the distance between the planes containing pairs of right-hand and left-hand wheels of each axle, according to the invention, constant. This makes it possible to maintain the nominal or small clearance between the flanges of the wheels and the rails, as well as the tolerances between the wheel flanges and the safety rails.

The connecting rod device, or devices, with a broken or divided connecting rod consisting of two connecting rod sections also make it possible to ensure the convergence of the wheels inside and outside the radius of curvature towards a common instantaneous center of rotation, so as to orient the wheel flanges in a direction which is strictly or substantially tangential to the rails.

In a specific embodiment of an axle assembly according to the invention, the side bars are coupled to one another at each end by a first and second connecting rod device each consisting of two connecting rod sections articulated at the break point or junction to a first relay lever and to a second relay lever, respectively, connected to a cross member carrying the body of the vehicle.

According to one embodiment of the invention, the directional relay lever is mounted on a pivot articulated to a longitudinal extension perpendicular to the cross member.

This connecting rod device comprising with a divided connecting rod is articulated to levers for steering the wheels oriented with respect to one another so as to ensure the convergence of the axes of the wheels inside and outside the curvature towards a common instantaneous center of rotation, and to thereby orient the flanges of the wheels in a direction which is strictly tangential to the rails.

In further embodiments of a railway axle assembly according to the invention, each side bar consists of a double steering lever and the cross member consists of a sliding or telescopic axle body or of a sliding or telescopic axle mount.

The invention also relates to a railway bogie axle assembly which, in one specific embodiment, has side bars each consisting of two sections articulated to one another about substantially vertical pivots, each section carrying at least one wheel and in which the articulation means on the side bars have variable relative positions.

BRIEF DESCRIPTION OF THE INVENTION

These features and details of the invention, along with others, will be apparent from the following description, and with reference to the appended drawings.

In these drawings:

FIG. 2 is a side elevation of the axle illustrated in FIG. 1;

FIG. 4 is a plan view on a curved track of the axle assembly illustrated in FIGS. 1, 2 and 3;

FIG. 5 is a plan view of a second embodiment of an axle assembly according to the invention;

FIG. 7 is a transverse elevation of the axle illustrated in FIGS. 5 and 6;

In these figures, the same reference numbers denote identical or analogous elements.

DESCRIPTION OF THE PREFERRED EMBODIMENTS

Figure 1:
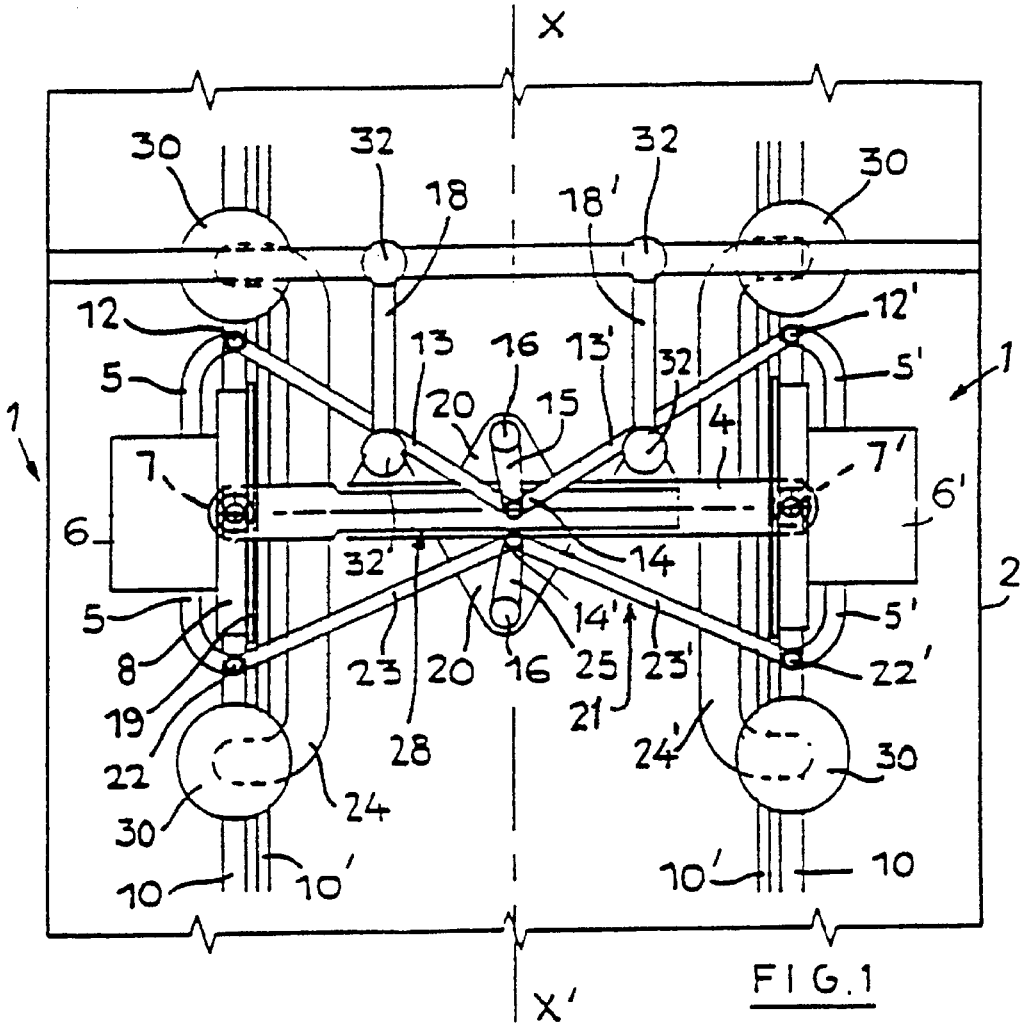
FIG. 1 is a plan view of a first embodiment of an axle assembly according to the invention.
Figure 3:
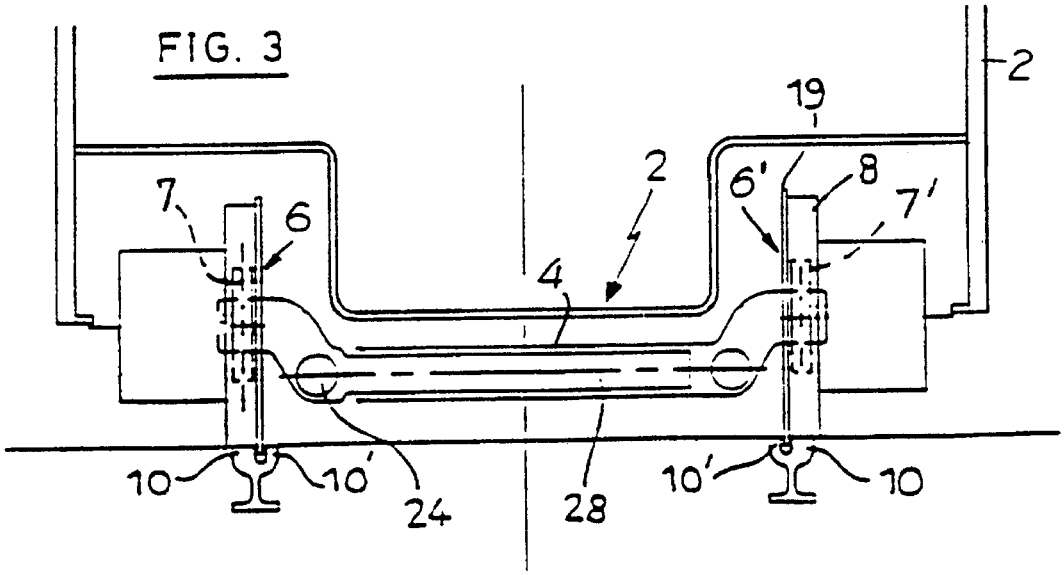
FIG. 3 is an end view of the axle illustrated in FIGS. 1 and 2.
Figure 6:
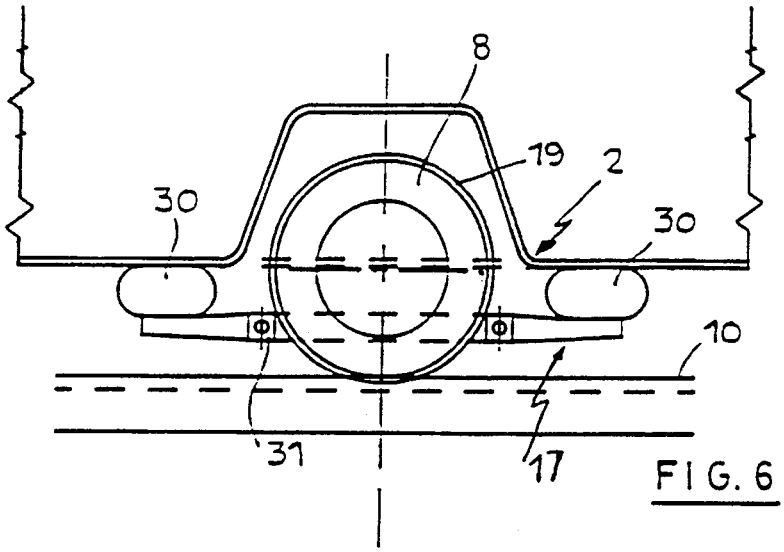
FIG. 6 is a side elevation of the axle illustrated in FIG. 5.
Figure 8:
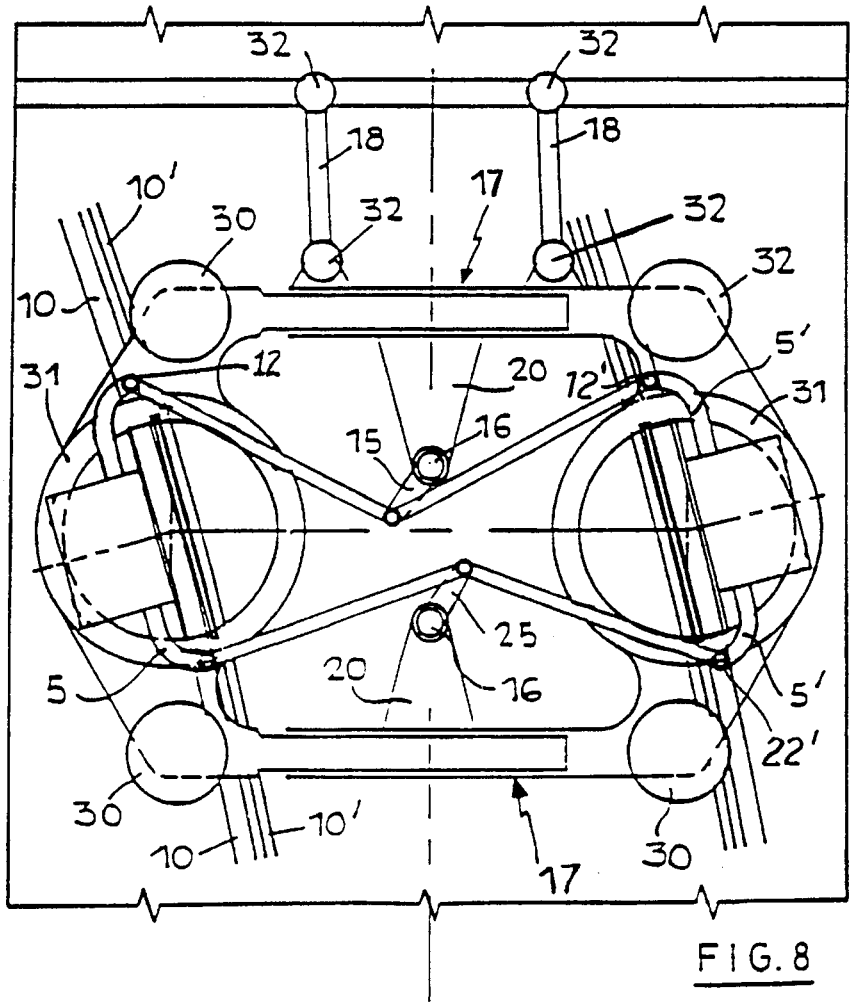
FIG. 8 is a plan view on a curved track of the axle assembly illustrated in FIGS. 5, 6 and 7.

The axle assembly according to FIGS. 1 to 4 is intended to carry a body or part of a body 2 of a railway vehicle or railway car with a lowered floor 3, as shown in FIGS. 1 to 4. This axle assembly comprises two side bars 5, 5' which each extend from an articulation means 6, 6' securing the said side bars to outer member 4 of a telescopic axle and sliding axle member 28. As illustrated in FIG. 1, on straight tracks 10, the side bars are oriented parallel to the track towards the front and/or towards the rear and are arranged symmetrically, on each side of a longitudinal vertical plane containing the longitudinal axis X–X' of the body 2 of the railway car.

As shown in FIGS. 1 to 4, each side bar 5, 5' comprises a double steering lever articulated to the axle member 4 by articulation means consisting of real pivots 7, 7' comprising substantially vertical spindles. The side bars 5, 5' each carry a motorized or non-motorized wheel 8 intended to follow a pair of rails 10 provided with safety rails 10'. The side bars 5, 5' are coupled to one another at each end with the aid of connecting rod devices 11, 21 mounted with pivots 12, 22, 12', 22' on the ends of side bars 5, 5' and consisting of a divided connecting rod comprising connecting rod sections 13, 13' and 23, 23' respectively. Each of the connecting rod sections are articulated or joined, at the break point 14, 14' to a relay lever 15, 25 mounted with a pivot 16 on an extension 20 of the outer member 4 of the telescopic axle.

Coil springs or pneumatic means 30 as well as dampers mounted on extensions 24, 24' of the outer member of the telescopic axle 4 to provide secondary suspension between the axle assembly 1 and the body 2 of the vehicle. The outer member 4 is positioned with respect to the body 2 of the vehicle by reaction connecting rods 18, 18' mounted on ball joints 32.

The geometric proportions of the divided connecting rods 13, 13', 23, 23' of the telescopic axle body 4, 28, and of the reaction connecting rods are chosen so that the nominal points of contact of the wheels 8 with the rails 10 move away from one another as a function of the swing angle of the wheels, in order to keep the clearances between the flanges 19 of the wheels 8 and the rails 10, or between the flanges 19 of the wheels 8 and the safety rails 10' constant, and to orient the flanges 19 of the wheels 8 along tangents to the curvature of the rail 10, or parallel to the straight rail.

In a second embodiment of an axle assembly according to the invention, illustrated in FIGS. 5 to 8, the side bar 5, 5' each joined to a double steering lever carrying a single wheel 8, which wheel may or may not be motorized, are geometrically connected to each other on each side of each wheel 8 by first and second connecting rod devices 11, 21 according to the invention mounted with pivots 12, 12' and 22, 22' on a telescopic sliding axle mount 17. Each connecting rod device 11, 21 consists of two connecting rod sections 13, 13', 23, 23' articulated, at the break point 14, to relay levers 15, 25 mounted with a pivot 16 on a longitudinal extension 20 on each transverse side of the telescopic sliding axle mount.

The telescopic sliding axle mount 17 consists of two telescopic elements which slide along two parallel transverse sides, the master elements of the sliding mount being positioned with respect to the body of the vehicle with the aid of reaction connecting rods 18, 18'.

The geometric proportions of the telescopic sliding axle mount 17, the connecting rod sections 13, 13', 23, 23', the relay levers 15, 25, the extensions 20 of the sliding mount 17, and the reaction connecting rods 18, 18' are chosen so that the nominal points of contact of the wheels 8 with the rails 10 move away from each other when the axle passes round a bend or curve in the track, in a way which is coordinated with the swinging angle of the wheels 8, so as to keep the nominal clearance between the flanges 19 of the wheels 8 and the rails 10/counter rails 10' constant, and to position the flanges 19 of the pairs of wheels on the inside and outside of the bend so that they are strictly tangential to the rails.

Figure 9:
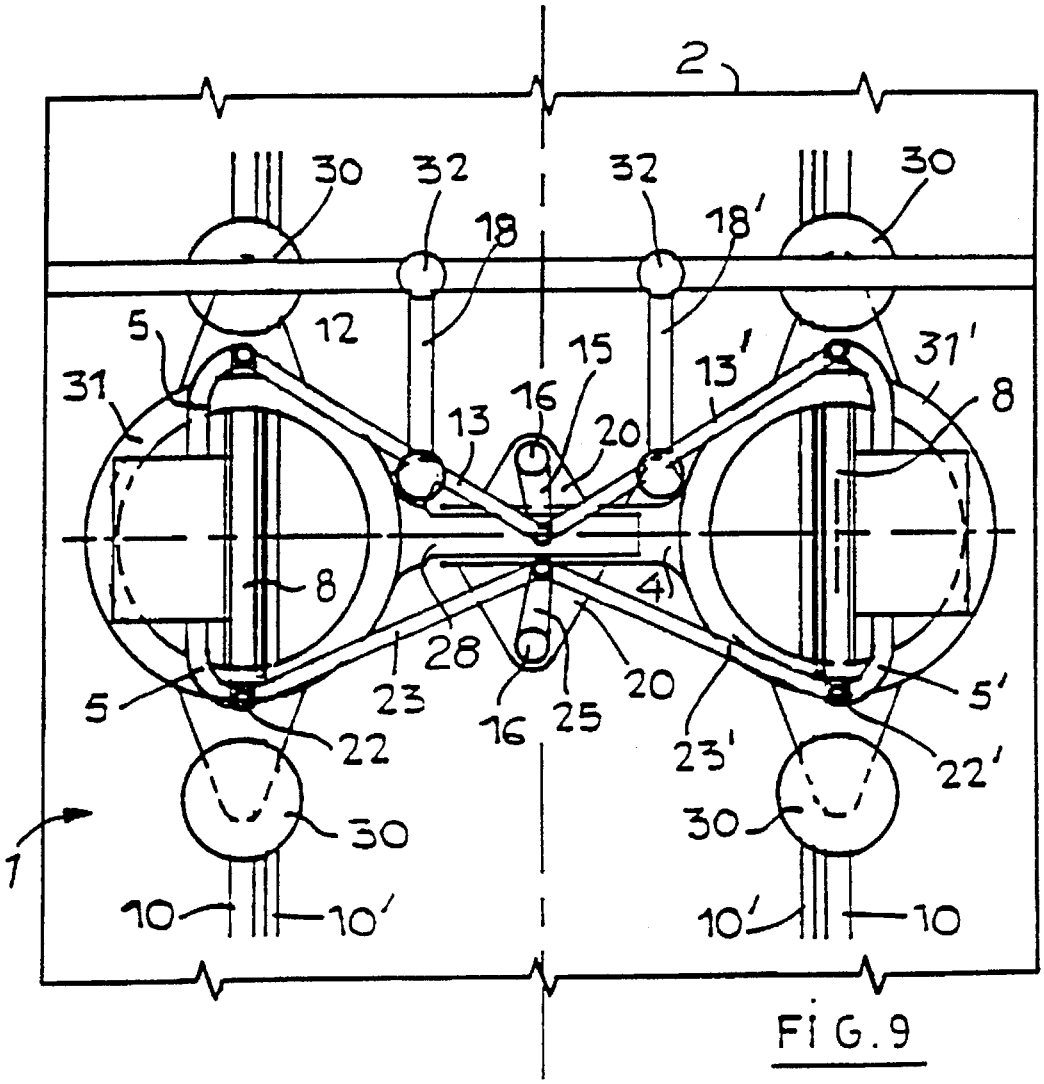
FIG. 9 is a plan view of a third embodiment of an axle according to the invention.

A third embodiment of an axle according to the present invention is illustrated in FIG. 9. This axle comprises two side bars 5, 5' each comprising a double steering lever, coupled by a virtual pivot comprising a substantially horizontal ball-bearing rings 31, 31' to a telescopic axle 4, 28 comprising a sliding axle 28 and outer member 4, the latter carrying the railway vehicle body 2 by means of air cushions 30.

The telescopic axle (4, 28) is positioned with respect to the body 2 of the vehicle by reaction connecting rods 18, 18' mounted on ball joints 32.

The side bars are coupled to one another at each of their free ends by connecting rod devices 11, 21 connecting rod sections 13, 13', 23, 23' and relay levers 15, 25 arranged so that when passing round a bend, the relay arms 15, 25 swing about pivots 16 in a direction opposite to the arcs described by the side bars 5, 5' to which their respective connecting rod sections are attached.

Figure 10:
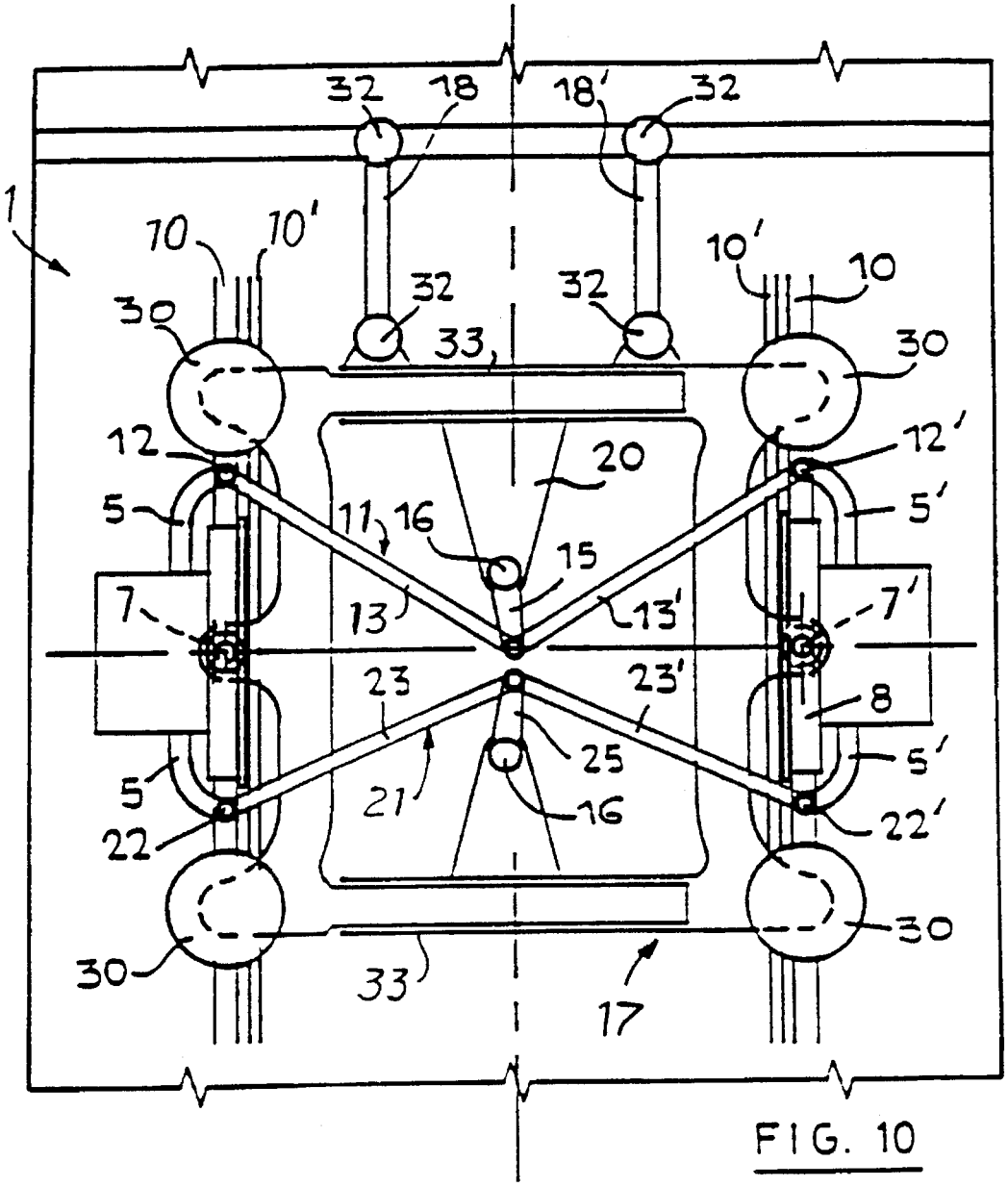
FIG. 10 is a plan view of a fourth embodiment of an axle according to the invention.

In a fourth embodiment of an axle assembly according to the invention, illustrated on a rectilinear trajectory on straight tracks in FIG. 10, the axle assembly 1 comprises two side bars 5, 5' each comprising a double steering lever coupled by a real pivot, characterized by a substantially vertical spindle 7, 7', to a cross member comprising a telescopic sliding axle mount 17 formed from two telescopic elements which slide along two parallel transverse sides 33, 33'. The side bars 5, 5' each carry a motorized or non-motorized wheel 8. The sliding mount 17 carries the body of the railway vehicle by means of air cushions 30. The side bars are coupled to one another and at each of their free ends by a connecting rod device 11, 21 with divided connecting rod sections 13, 13', 23, 23' and relay levers 15, 25. The connecting rod device 11, 21 is arranged so that when passing round a bend, relay levers 15, 25 swing about their respective pivots in a direction opposite to that of the side bars 5, 5' to which their respective connecting rod sections are attached.

The sliding mount 17 is positioned with respect to the body 2 of the vehicle by reaction connecting rods 18, 18' mounted on ball joints 32.

Figure 11:
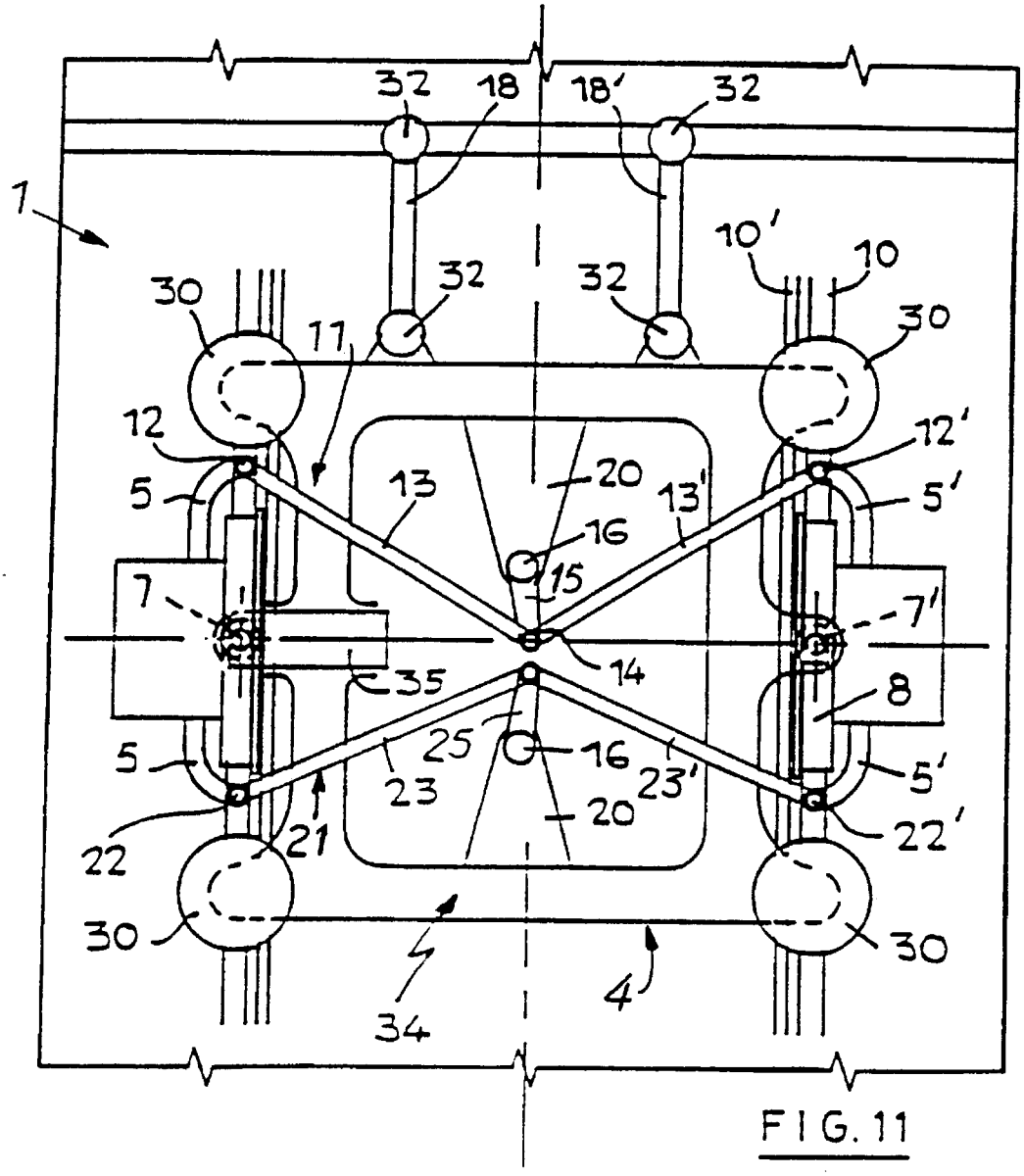
FIG. 11 is a plan view of a fifth embodiment of an axle according to the invention.

A fifth embodiment of a railway axle assembly with orientable wheels and variable width is shown in FIG. 11 on a rectilinear trajectory. The assembly axle comprises two side bars 5, 5' each materialized by a double steering lever coupled by a real pivot comprising a substantially vertical spindle 7, 7' to a rigid axle mount 34 equipped on just one side with a sliding axle extension 35 and carrying railway vehicle body 2. Side bars 5, 5' are coupled to one another at each of their free ends by connecting rod devices 11, 21 consisting of a divided connecting rod comprising connecting rod sections 13, 13', 23, 23' and relay levers 15, 25, the connecting rod device 11, 21 being arranged so that when passing round a bend, relay levers 15, 25 swing about their pivots 16 in a direction opposite to the direction of movement of the side bars 5, 5' about spindles 7, 7'.

Figure 12:
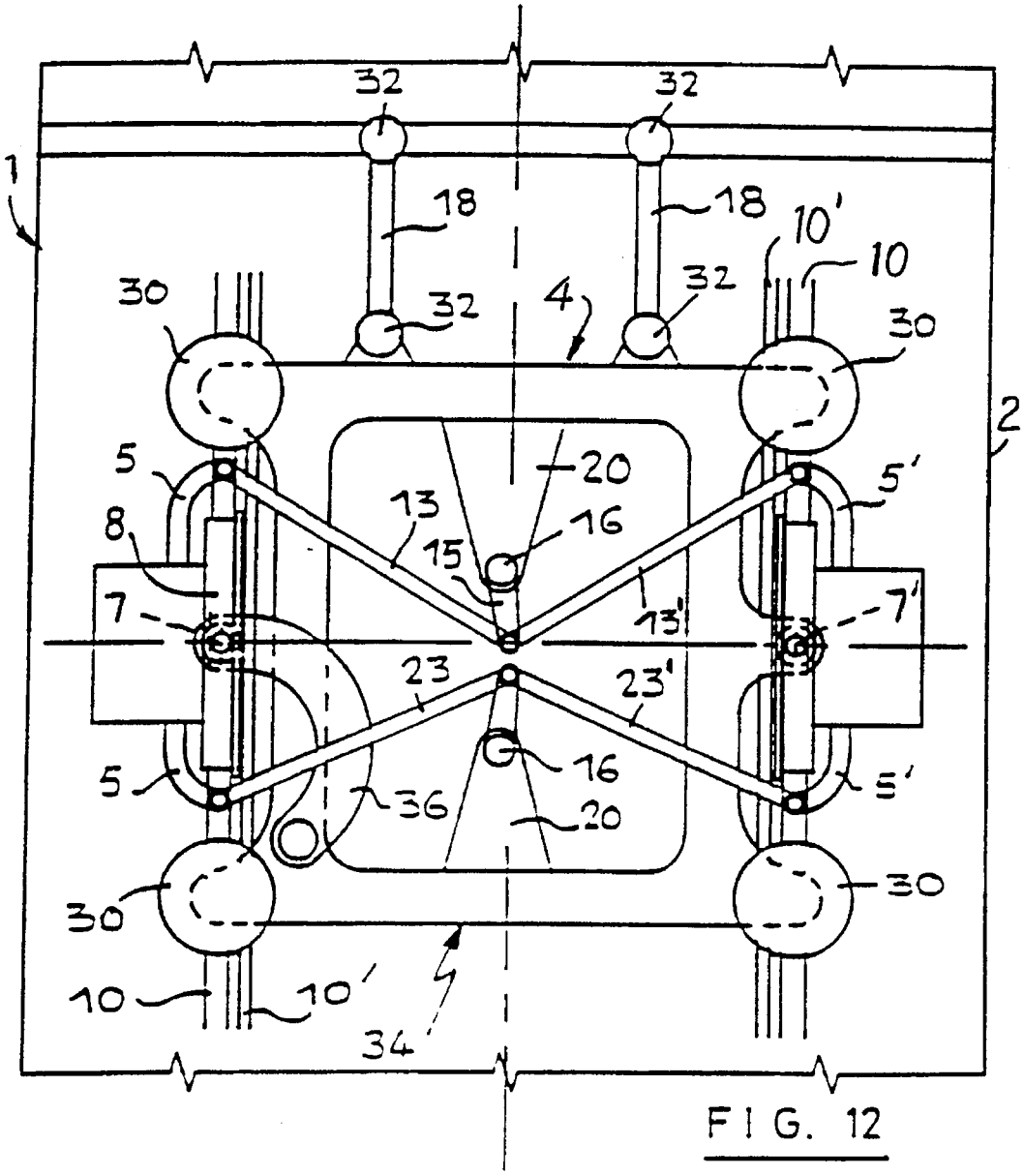
FIG. 12 is a plan view of a sixth embodiment of an axle according to the invention.

A sixth embodiment is illustrated in FIG. 12, on a rectilinear trajectory. The axle assembly 1 comprises two side bars 5, 5' each comprising a double steering lever coupled by a real pivot comprising substantially vertical spindles 7, 7' to a rigid axle mount 34 equipped on just one side with a swinging carrying arm 36, the mount 34 carrying a railway vehicle body 2. Side bars 5, 5' are coupled to one another at each of their free ends by a connecting rod device with a divided connecting rod comprising connecting rod sections 13, 13', 23, 23' and relay levers 15, 25 arranged so that when passing round a bend, the relay arms swing about pivots 16 in a direction opposite to that of the direction described by side bars 5, 5'.

Figure 13:
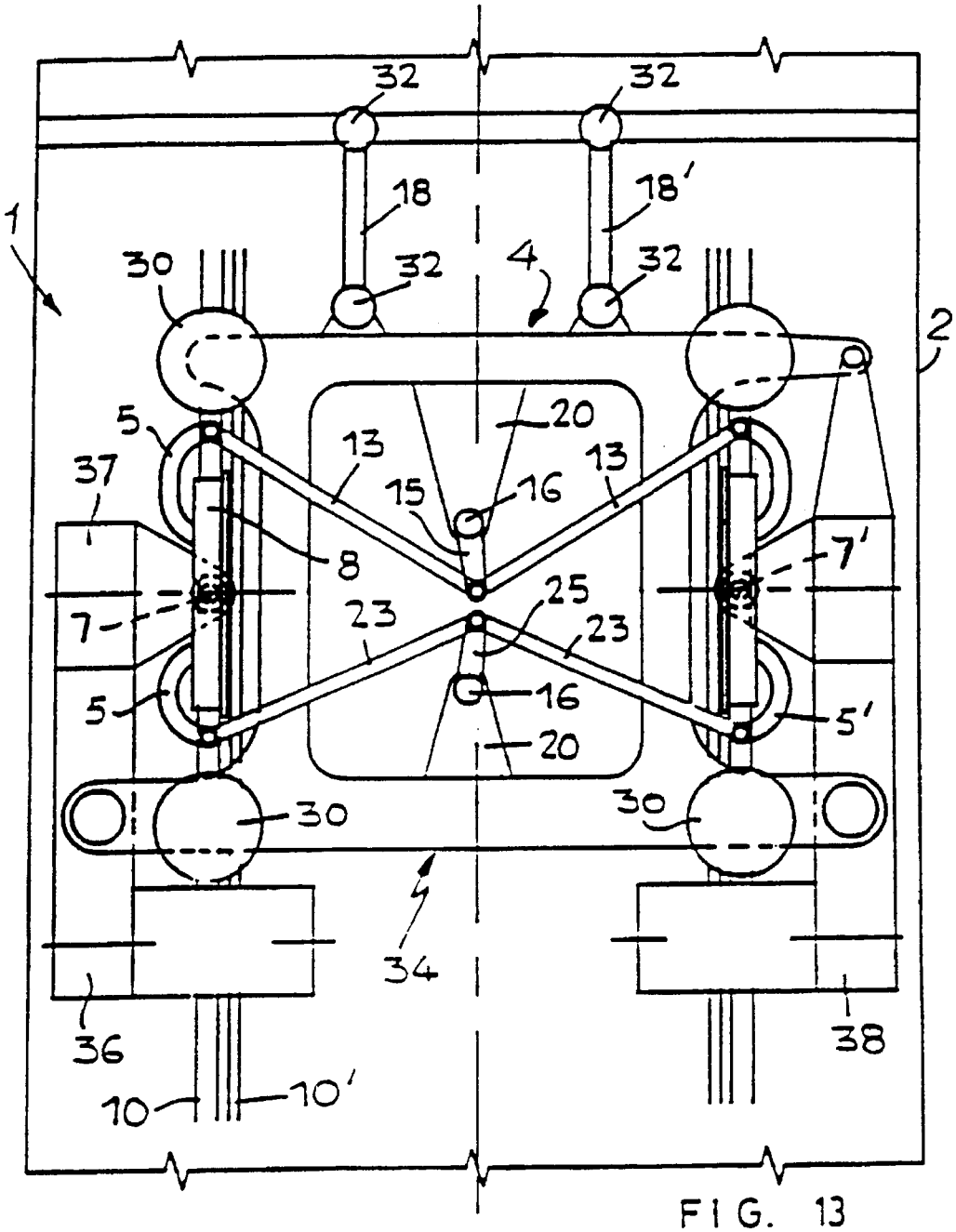
FIG. 13 is a plan view of a seventh embodiment of an axle according to the invention.

In a seventh embodiment illustrated in FIG. 13, axle assembly 1 comprises two side bars 5, 5' each comprising a double steering lever coupled by a real pivot comprising a substantially vertical spindle 7, 7' to a rigid axle mount 34 equipped on just one side with a swinging and motorized carrying arm 36 equipped with a cardan joint 37 or any equivalent mechanical device concentric with the real pivot 7, and, on the other side, with a similar but non-swing motorized carrying arm 38, mount 34 carrying the railway vehicle body 2. Side bars 5, 5' are coupled to one another at each of their free ends by connecting rod devices consisting of a divided connecting rod comprising connecting rod sections 13, 13', 23, 23', and relay levers 15, 25.

Figure 14:
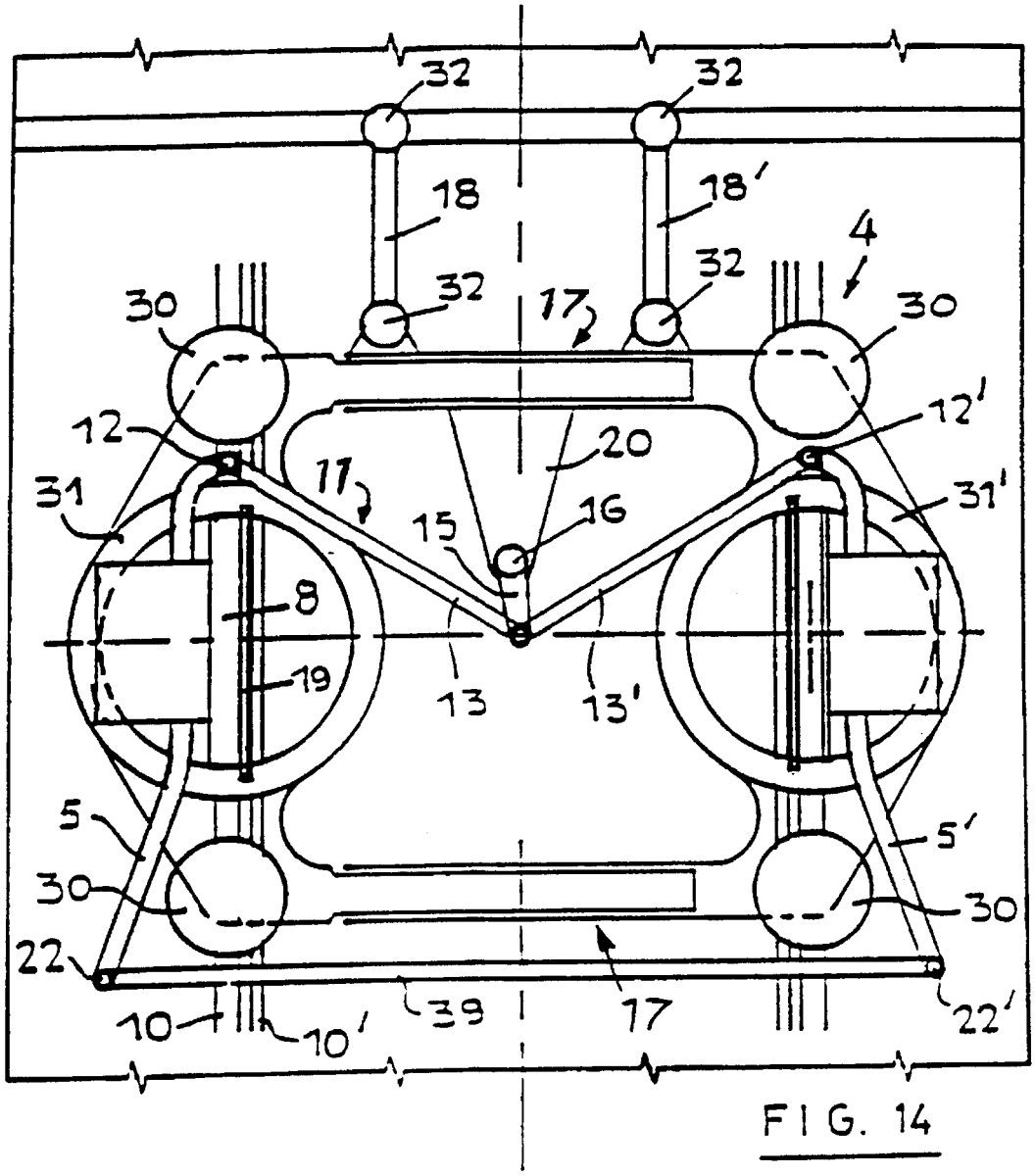
FIG. 14 is a plan view of an eight embodiment of an axle according to the invention.
Figure 15:
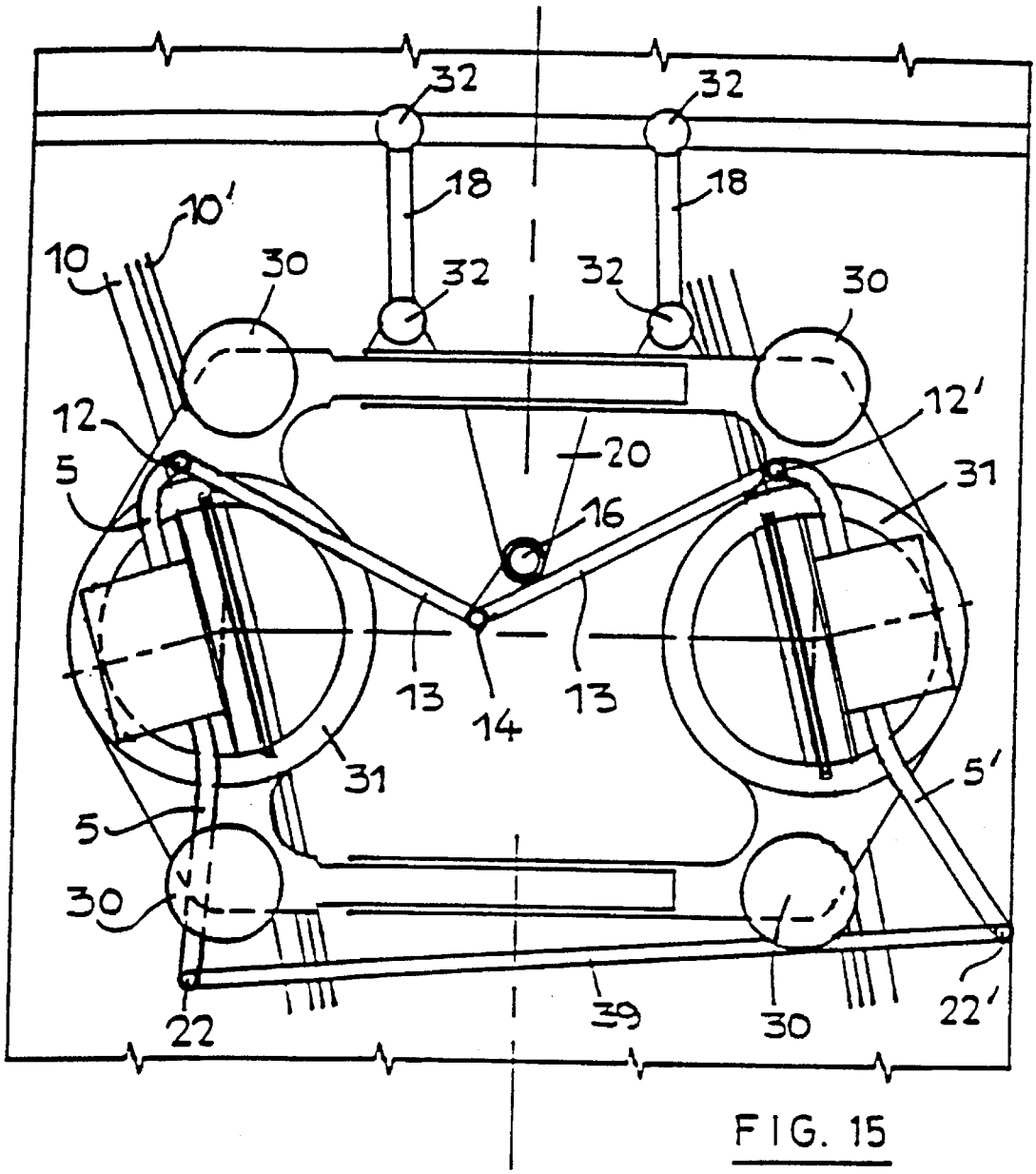
FIG. 15 is a plan view on a curved track of the axle illustrated in FIG. 14.

An eighth embodiment constitutes a variant of any one of the seven preceding embodiments. In FIGS. 14 and 15, the eighth embodiment is represented in plan view as a variation of the second embodiment. The axle assembly comprises two side bars 5, 5' each comprising a double steering lever coupled by a virtual pivot, said pivot comprising substantially horizontal ball-bearing rings 31, 31' to a cross member 4 comprising telescopic sliding axle mount 17 carrying the railway vehicle body 2. Side bars 5, 5' are coupled to one another at a first end by a connecting rod device 11 consisting of a divided connecting rod comprising connecting rod sections 13, 13', joined at break point 14 and mounted with pivots 12, 12' on the first ends of side bars 5, 5', and relay lever 15 mounted with pivot 16 on longitudinal extension 20 perpendicular to a transverse side of the sliding mount 17.

The side bars 5, 5' are connected to each other at a second end by conventional connecting rod 39 of constant length, mounted on the side bars 5, 5' with the aid of pivots 22, 22'.

Figure 16:
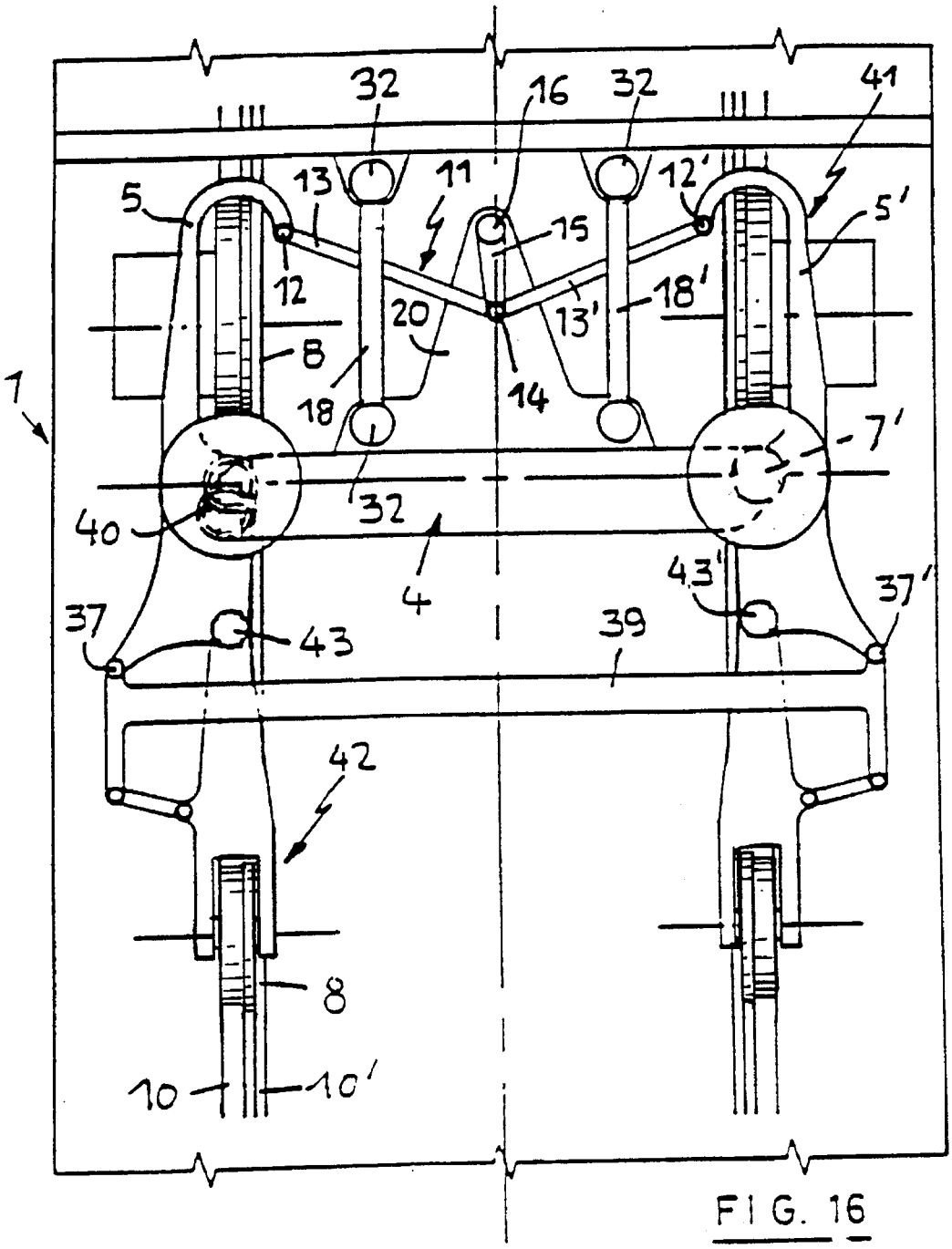
FIG. 16 is a plan view of one embodiment of a bogie axle according to the invention.
Figure 17:
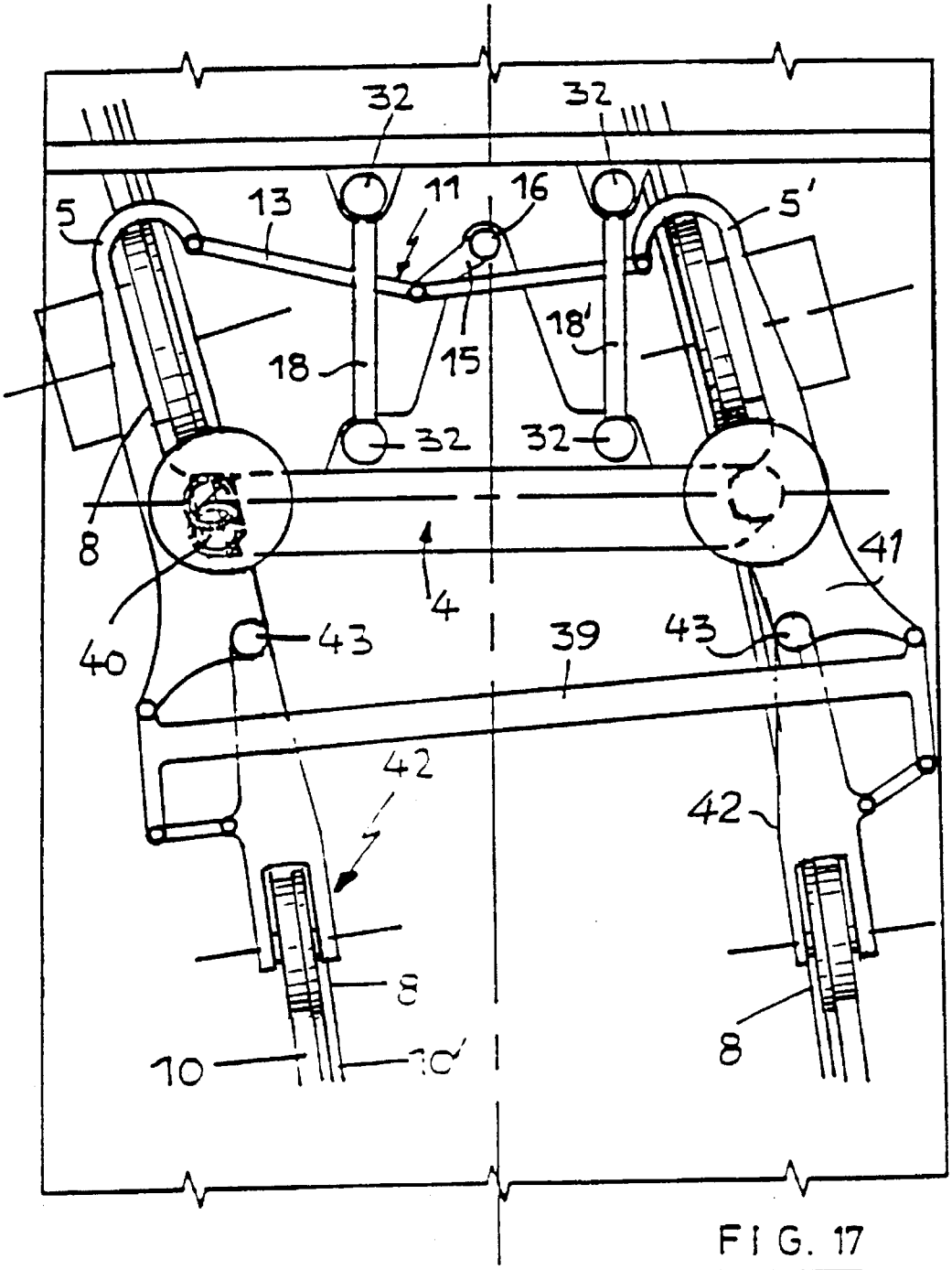
FIG. 17 is a plan view, on a curved track, of the bogie axle illustrated in FIG. 16.

The invention also relates to a railway bogie axle. A particular embodiment of a bogie axle assembly of variable width according to the present invention is illustrated in FIGS. 16 and 17. Bogie axle assembly comprises two side bars 5, 5' each comprising a carrying arm arranged symmetrically on each side of a longitudinal vertical plane and extended by a steering lever coupled on one side of the vertical plane by a real pivot comprising a substantially vertical spindle 7 and, on the other side, by a real pivot device with offset similar to one of those described in document EP-B-0,348,378, having a spindle with an eccentric, or by a crank 40 acting as a carrying arm, to a cross member comprising the load-bearing cross member of the bogie, and carrying a railway vehicle body 2.

The side bars 5, 5' are geometrically connected at a first end by a connecting rod 39 which is not broken or divided and of constant length, mounted on the side bars 5, 5' with the aid of pivots 37, 37'. Connecting rod 39 extends substantially transversely to the longitudinal vehicle axis.

Side bars 5, 5' are geometrically connected at their second end by a connecting rod device 11 according to the invention. Connecting rod device 11 consists of a divided connecting rod comprising connecting rod sections 13, 13' mounted on the side bars with pivots 12, 12' and joined at break point 14, and of a directional relay lever 15 mounted on a pivot 16 articulated to a longitudinal extension 20 fixed rigidly perpendicularly to the cross member 4.

Off-centering device 40 allows transverse movement compensating for the decrease in the spacing of the side bars 5, 5' with respect to one another. With the assembly of a connecting rod 39 of constant length at the rear ends of the side bars 5, 5' and off-centering device 40 the pivots in the middle of the side bars, it is possible to join only the front ends of the side bars 5, 5' by a connecting rod device 11 of variable length in accordance with the invention.

This connecting rod device 11 comprises a divided connecting rod comprising connecting rod sections 13, 13' and relay lever 15 mounted with pivot 16 on longitudinal extension 20 perpendicular to the cross member 4.

The connecting rod device 11 is arranged so that when passing round a bend, relay lever 15 swings about its pivot 16 in direction opposite to that of the direction described by side bars 5, 5'.

The off-centering device 40 and the connecting rod device 11 according to the invention must be mounted in a direction and at a precise distance from the wheels 8 such that the geometric proportions of the articulated connecting rod sections 13, 13', of the relay lever 15, and of the arm 39 of the cross member are chosen so as to correct the variation in distance between the planes of the left-hand and right-hand wheels when the bogie assembly enters a curve in the track. This makes it possible to keep the nominal clearances between the flanges 19 of the wheels 8 and the rails 10, or between the flanges 19 of the wheels 8 and the safety rails 10' constant and to keep the flanges 19 of the wheels 8 in a vertical plane tangential to the curvature of the rail, or parallel to the rail on straight sections of track.

The articulated side bars 5, 5' each consist of a first section 41 extended by a second section 42. Each second 41, 42 carries at least one wheel 8. The pivoting of the sections 41, 42 is coordinated by connecting rods mounted on pivots integral with the sections and by ball joints on the aforementioned connecting rod.

This pivoting of the two sections of each side bar 5, 5' about vertical spindle 5, 43, 43' allows each wheel 8 to be oriented directionally independently of each other in order to allow the flange 19 of each wheel 8 to best approximate the tangent to the section of rail 10 on which it bears.

Figure 18:
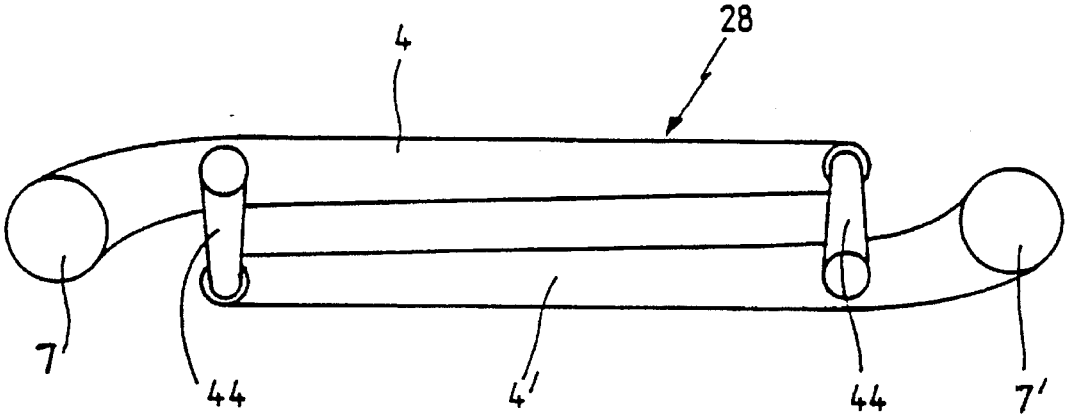
FIG. 18 is a plan view of a variant of a telescopic axle shown in FIGS. 1 to 4 and 9, one side of the sliding mount shown in FIGS. 5 to 8 and 10 or a cross member carrying articulation means.

FIG. 18 illustrates, by a plan view, a variant of a telescopic axle carrying a sliding axle body (28) shown in FIGS. 1 to 4 and 9.

It could also illustrate a side 27 of the sliding mount 17 shown in FIGS. 5 to 8 and 10, or even a cross member 4 carrying articulation means consisting of real pivots 7, 7' with a variable relative position with respect to each other.

This telescopic axle variant comprises two parallel cross members 4, 4' each one carrying, at an opposite end, a real pivot 7, 7', the said cross members being connected to one another by braces 44 articulated to each of the cross members 4, 4' near their other end.

We claim:

1. A railway axle assembly comprising two side bars (5, 5') articulated to opposing ends of a telescopic axle (4, 28), an outer member (4) of said axle for carrying a vehicle body (2), said side bars being pivotable directionally, and orientable flanged wheels (8) rotatably carried by said side bars (5, 5') to follow curvatures of a railway track, wherein the respective ends of said side bars (5) are coupled to one another by at least one connecting rod device, said at least one connecting rod device comprising two connecting rod sections joined at a break point by a relay lever (15), said relay lever pivotally connected to said outer member (4) of the telescopic axle, the angular movement of the pivoting relay lever defining an arc that is in a direction opposite to the arcs defined by the moving ends of the side bars (5, 5') to which said connecting rod sections are joined, so as to decrease the included angle between said respective connecting rod sections (13, 13'), and extend said telescopic axle (4,28) to thereby compensate for an increase in the distance between said wheels when said wheels (8) encounter a curve in said railway track and maintain the flanges (19) of said wheels (8) in close tangential relation with said railway track.

2. An axle assembly according to claim 1, wherein the side bars (5,5') are articulated about real pivots having substantially vertical spindles.

3. An axle assembly according to claim 1, wherein the side bars (5,5') are coupled to one another at each end by a first and a second connecting rod device (11,21) each device consisting of two connecting rod sections (13,13,23,23') articulated at a break point by pivot pins (14,14') respectively carried by a first relay lever (15) and a second relay lever (25) secured to the outer member of the telescopic axle (4) for carrying the body (2) of the vehicle.

4. An axle assembly according to claim 1, wherein the relay lever (15,25) is mounted on a pivot (16) articulated to a longitudinal extension (20) perpendicular to the telescopic axle (4).

5. An axle assembly according to claim 1, wherein the at least one connecting rod device comprising two connecting rod sections (13,13') is articulated to relay levers which cooperate to orient the wheels with respect to one another to effect the convergence of the wheels towards a common instantaneous center of rotation and orient the flanges (19) of the wheels (8) in a direction which is tangential to the rails.

6. An axle assembly according to claim 1, wherein the telescopic axle (4,28) comprises a sliding axle body (28) extending from the outer member (4).

7. An axle assembly according to claim 1 wherein the telescopic axle (4) comprises a sliding axle mount (17).

* * * * *